US007866272B2

(12) United States Patent
Ullman

(10) Patent No.: US 7,866,272 B2
(45) Date of Patent: Jan. 11, 2011

(54) CONTROL HANDLE FOR A VESSEL AND A VESSEL INCLUDING SUCH A CONTROL HANDLE

(76) Inventor: Johan Ullman, Johannebergsgatan 30, S-412 55 Göteborg (SE)

( * ) Notice: Subject to any disclaimer, the term of this patent is extended or adjusted under 35 U.S.C. 154(b) by 0 days.

(21) Appl. No.: 12/382,722

(22) Filed: Mar. 23, 2009

(65) Prior Publication Data

US 2009/0183665 A1 Jul. 23, 2009

(51) Int. Cl.
*B63H 20/12* (2006.01)

(52) U.S. Cl. ..... 114/146; 440/1

(58) Field of Classification Search ..... 114/145 R, 114/146, 150, 151; 440/1, 84, 87; 74/543
See application file for complete search history.

(56) References Cited

U.S. PATENT DOCUMENTS

| | | | | |
|---|---|---|---|---|
| 3,636,911 | A | 1/1972 | Piazza et al. | |
| 3,790,977 | A * | 2/1974 | Bombardier et al. | 114/357 |
| 3,989,002 | A * | 11/1976 | Peterson | 440/87 |
| 4,250,358 | A | 2/1981 | Gilbertson | |
| 4,337,053 | A | 6/1982 | Stevens | |
| 4,582,493 | A | 4/1986 | Toyohara et al. | |
| 4,641,723 | A | 2/1987 | Takanashi et al. | |
| 5,167,550 | A | 12/1992 | Nielsen | |
| 5,171,171 | A * | 12/1992 | Tani | 440/1 |
| 5,333,515 | A | 8/1994 | Schneider | |
| 5,350,325 | A | 9/1994 | Nanami | |
| 5,372,082 | A | 12/1994 | Hattori | |
| 5,474,007 | A * | 12/1995 | Kobayashi | 114/55.51 |
| 5,582,125 | A | 12/1996 | Matsumoto | |
| 5,593,330 | A | 1/1997 | Kobayashi | |
| 5,660,083 | A | 8/1997 | Huang et al. | |
| 5,813,357 | A * | 9/1998 | Watson | 114/145 R |
| 5,941,188 | A * | 8/1999 | Takashima | 440/87 |
| 6,032,605 | A | 3/2000 | Takashima | |
| 6,047,609 | A | 4/2000 | Brower et al. | |
| 6,085,684 | A | 7/2000 | Cotton | |
| 6,113,443 | A | 9/2000 | Eichinger | |
| 6,204,752 | B1 | 3/2001 | Kishimoto | |
| 6,280,269 | B1 | 8/2001 | Gaynor | |
| 6,406,342 | B1 | 6/2002 | Walczak et al. | |
| 2003/0024341 | A1 | 2/2003 | Ullman | |

FOREIGN PATENT DOCUMENTS

| | | |
|---|---|---|
| WO | WO 95/07836 | 3/1995 |

* cited by examiner

*Primary Examiner*—Lars A Olson
(74) *Attorney, Agent, or Firm*—Buchanan Ingersoll & Rooney PC

(57) ABSTRACT

A control handle for a vessel, the control handle having a handle bar, two handles, at least one throttle control arranged in connection with one or both handles, and an additional control. A vessel having a control handle for a vessel with a handle bar, two handles, at least one throttle control arranged in connection with one or both handles, and an additional control. The throttle control can be a twist grip. The additional control can be for adjustment of one or several of: shifting between forward or backward propulsion of the vessel, force distribution between motors provided on the vessel, adjustment of an angular position of trimming tabs of the vessel, adjustment of a banking angle of a propeller drive provided in the vessel, and adjustment of a position of a reversing scoop of a water jet.

7 Claims, 3 Drawing Sheets

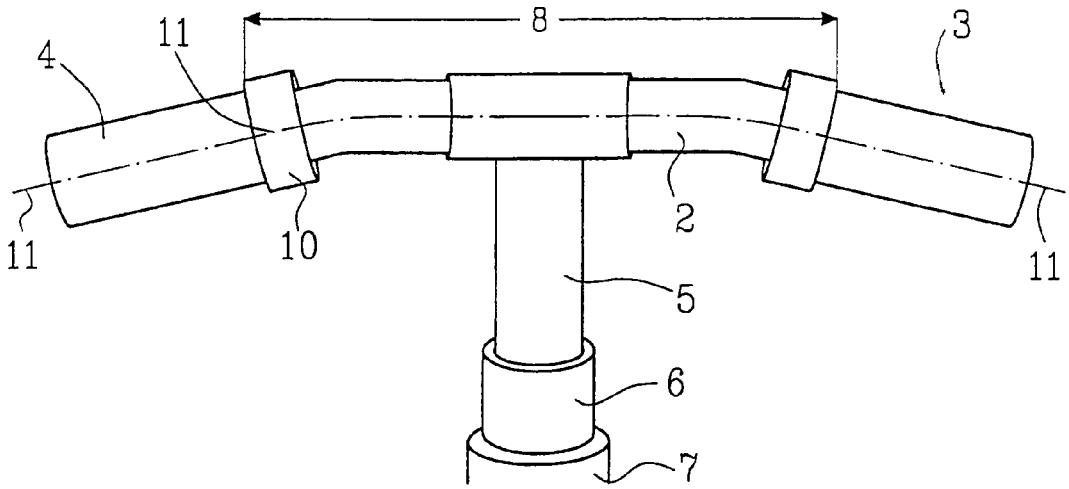
FIG. 1
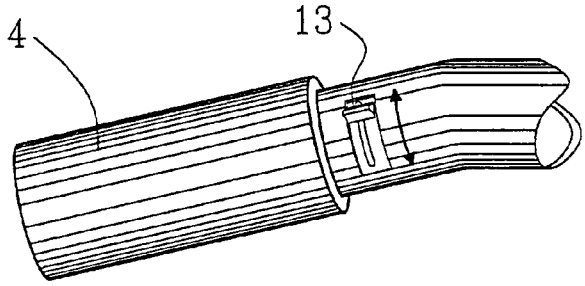
FIG. 2
FIG. 3
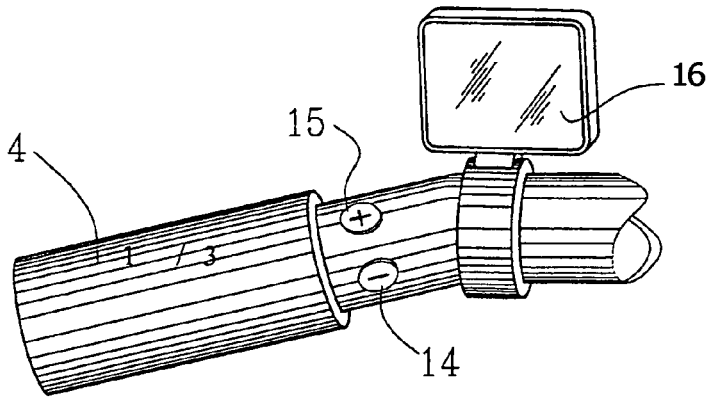

CONTROL HANDLE FOR A VESSEL AND A VESSEL INCLUDING SUCH A CONTROL HANDLE

TECHNICAL FIELD

The patent application concerns a control handle for a vessel and a vessel. Further, it concerns a vessel with water jet propulsion. Especially, it concerns a control handle and a vessel including a control handle, where the control handle comprises a handle bar.

BACKGROUND OF THE INVENTION

Today's motorboats are mostly controlled by a steering wheel. The rotation speed control for acceleration and retardation of the motorboat is usually made using one or two levers mounted on a support at a distance from the steering wheel. Shifting between forward and backward propulsion is usually controlled with an additional lever, which is usually arranged on said support.

In some vessels, especially in so-called water scooters, the steering wheel has been replaced by a handle bar. The usage of a handle bar instead of a steering wheel leads to a number of advantages for the driver. A handle bar provides for better control of the boat as the proprioceptive signals are more directly related to the reaction of the boat: if the handle bar is turned to a certain angle, the boat will follow the same angle. This is to be compared with a conventional wheel where a rudder angle of 90° is obtained by a steering wheel movement of 540°. In addition, the handle bar stabilizes the driver during ride. Furthermore, the handle bar provides a more ergonomic grip for the hand, whereby the risk of injuries of the hands and loss of control of the vessel in rough sea are reduced.

U.S. Pat. No. 5,582,125 describes a vessel provided with a handle bar. The handle bar is provided with a throttle control handle in each end of the handle bar. The throttle control handles are designed as lever arms mounted in connection with the handles of the handle bar. The lever arms are to be gripped with an open hand whereby the thumbs rest on the underside of the handles of the handle bar and the rest of the fingers are intended to rest on the lever arms. This grip, with an open hand, leads to a risk of thumb injuries during rough sea whereby the control over the vessel can be lost.

Further, U.S. Pat. No. 3,636,911 describes a vessel provided with a handle bar, which handle bar is provided with a throttle twist grip.

The vessels in both mentioned documents lack additional control handles arranged in connection with the handle bar.

The object of the invention is to provide a control handle for a vessel and a vessel including such a control handle, where the safety during operation is further increased.

SUMMARY OF THE INVENTION

Said object is achieved with a control handle according to the characterizing portion of claim 1. By providing a control handle comprising a handle bar with two handles, where at least one additional control is provided at one of the handles, which control is accessibly arranged for adjustment of a desired position with a thumb or forefinger of the driver while keeping the rest of the fingers in a closed grip around the handle, there is provided a possibility of adjusting at least one additional function at the vessel, such as for example adjustment of the trimming tab angle, the propeller banking angle, distribution of propulsion force between a set of motors or selection of forward or backward propulsion, which function is necessarily adjusted under operation. In this way the driver does not need to neither move the hands from the handle bar nor loosen the grip of the handle bar during operation, which increases the driver's control of the vessel and decreases the risk of hand injury to the driver.

In a preferred embodiment, one or several additional controls are arranged on the thumb side of and in immediate vicinity of one of said handles. By such a placement, the driver can get access to the control handle or the control handles without loosen the grip around the handle bar and with a maintained grip around the handle bar. The driver only needs to open the forefinger or alternatively move the thumb to be able to effect the control handle. Thus, the rest of the fingers can be held clenched around the handle, which gives a safe grip for the driver.

In a preferred embodiment of the invention, a throttle control in the form of a throttle twist grip. By using a throttle twist grip, a control device is provided for a throttle control where the driver with a closed grip around the handle can adjust the throttle, which results in good maneuvering safety.

In an additional preferred embodiment of the invention, additional controls are provided on surfaces which are substantially facing each other, whereby good accessibility of the controls are obtained without the driver needing to loose the grip of the handle.

By providing a vessel comprising at least a driving motor, ailerons or a trimming tabs for adjustment of the vessel's position during operation and a control handle for said vessel where said control handle comprises a handle bar, a first and a second handle supported by the handle bar with throttle control and control handles for ailerons or trimming tabs are accessibly arranged for adjustment of a desired position with a maintained, closed grip by middle finger, ring finger and little finger around the handle, a vessel is obtained where controls which are necessary to access during ride are arranged so that access is guaranteed where the driver does not need to move his hands from the handle bar or loosen the grip around the handle bar during operation, which increases the driver's control of the vessel and decreases the risk of hand injuries to the driver.

In a preferred embodiment, a control handle for selection of forward and backward propulsion respectively is also arranged to be accessible with a maintained grip.

In a further embodiment, a control handle for distribution of force, which is arranged to be accessible with a maintained grip.

DESCRIPTION OF THE DRAWINGS

In the following, the invention will be described in detail with reference to the enclosed drawings, in which:

FIG. 1 shows an embodiment of a control handle,

FIG. 2 shows a first alternative embodiment of a transmission control handle, FIG. 3 shows a second alternative embodiment of a transmission control handle.

PREFERRED EMBODIMENTS

Figure 4:
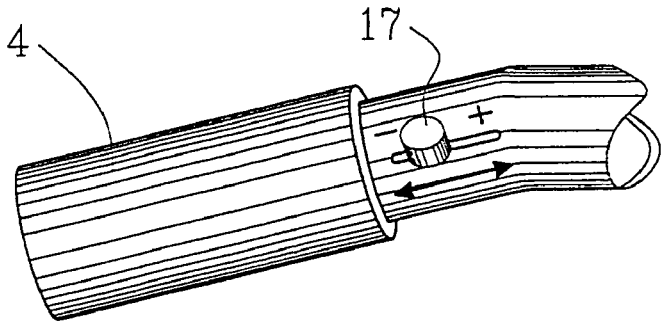
FIG. 4 shows an embodiment of a control handle suitable for adjustment of trimming tabs.

FIG. 1 shows a control handle 1 for a vessel comprising a handle bar 2, the handle bar being provided with a first handle 3 having a throttle twist grip and a second handle 4. The handle bar 2 is supported by a rotatably mounted steering axle 5, which is rotatably supported in a steering column 6 which is mounted to a support 7. The support is thereafter mounted in a known way to a not shown vessel. In a preferred embodiment of the invention the handle bar 2 comprises a centre portion 8 which extends substantially perpendicular to the steering axle 5. Two handles 3, 4 extend out from each side of the centre portion. Preferably, the handles 3, 4 are directed slightly backwards downwards in the vessel, which results in an ergonomic grip. In a preferred embodiment, the handles are inclined about 15° backwards towards the driver in relation to the centre portion of the handle bar.

Further, at one of said handles 3, 4 it is provided at least one additional control handle 10, which is accessibly arranged for adjustment of a desired position with a driver's thumb or forefinger with a maintained closed grip around the handle by the rest of the fingers. In the embodiment shown in FIG. 1 this control handle consists of a transmission control 10 formed as a rotatable cylinder preferably concentric with the handle 4 on which the control handle is mounted. Thus, this additional control handle 10 is mounted on the thumb side 11 of and in immediate vicinity of the handle 4.

The control handle is provided with a least one additional control handle as described above. This control handle is adapted to control one or more of the following functions: forward or backward propulsion of the vessel, force distribution between the motors of the vessel, adjustment of the trimming tab angle or adjustment of the propeller banking angle. Thus, the control handle is suitable for vessels which have two or more of said functions.

In the following, it will be described which control handles are suitable for the above mentioned functions and which are mounted on the thumb side of and in immediate vicinity of a handle 3, 4, whereby maneuvering of the control is permitted without having to open or loose the grip around the handle.

The throttle control 3 is designed as a throttle twist grip, which means that the throttle control is designed as a handle which is rotatable around its own longitudinal axle 11. In a preferred embodiment, the throttle control is springing back, whereby the handle automatically returns to its zero position when the driver releases the hold of the grip. This means that the handle is provided with a so-called dead man's grip, which increases the safety if the driver would loose control of the handle bar and the vessel. If the handle is designed with spring back, the force that is needed to hold the grip in a certain position increases with increased acceleration. This implies that the handle is formed with tactile feedback, which contributes to an increased driving safety. The throttle control can be optionally arranged on either the right or the left side of the handle bar, or on both sides alternatively, which is to prefer in connection with vessels with two or more motors installed. To obtain an increased safety, the throttle control in a preferred embodiment is designed with one or several projections, to which the forefinger or the thumb can be pressed when the handle is rotated. An advantage with such a solution is that the length of the lever arm for rotating the handle is increased, whereby it is easier to rotate the handle. It is also possible to design the projections with a blocking function for putting in the gear and shifting the gear.

As indicated above, a prior art control handle for selecting forward or backward propulsion consists of a lever provided on a support mounted at a distance from the steering wheel of the vessel. According to a preferred embodiment in which a safe control is to be obtained, the control handle for selecting forward and backward propulsion respectively should be accessibly arranged for adjustment of desired position with the thumb or the forefinger of the driver with a maintained grip around the control handle with the rest of the fingers. In the following, several preferred embodiments of transmission controls will be presented.

In a preferred embodiment, as shown in FIG. 1, the transmission control is designed as a rotatable, principally cylinder-formed control handle 10 mounted on the thumb side of and in immediate vicinity of the handle 4. Preferably, the control handle 10 is concentric with the handle 4 and has a larger diameter than the handle 4. In an alternative embodiment, the handle 4 is rotatable and works as a transmission twist grip.

FIG. 2 shows an alternative embodiment of the transmission control where the transmission control is designed as a sliding control handle 13 which can be displaced perpendicular to the longitudinal extension of the handle 4. The sliding control handle 13 is mounted on the thumb side of and in immediate vicinity of one of said handles to be accessible for adjustment to a desired position, preferably by the rider's thumb with a maintained grip around the handle by the rest of the fingers. In a preferred embodiment of the invention, the sliding control handle can be provided with a recess in the middle, whereby a better grip for the thumb can be obtained.

FIG. 3 shows an additional embodiment of a control handle for controlling the backward and forward propulsion respectively of the vessel. In this embodiment the transmission control handle is designed as two buttons 14, 15 where one of them is used for upshifts and the other for downshifts. In a preferred embodiment, the control handle is designed with a display 16, which shows what shift is put in at the moment. Said display can be mounted at the handle bar, but also in other locations where the eyes of the driver can naturally be focused. The display can also show additional information such as velocity, course and depth.

If the vessel is propeller-driven, the transmission control is designed with three distinct levels, one for forward propulsion, one for a neutral state and one for backward propulsion. If the vessel has a water jet propulsion, the control can be step-less. In vessels with water jet propulsion, the forward and backward propulsion respectively is controlled with a scoop that is retracted over the water jet. If the scoop is fully retracted, the water jet is drawn off in opposite direction, whereby full reverse is obtained. If the scoop is folded down to half, zero propulsion is obtained.

To be able to adjust the position of the vessel in the water during ride, the vessel is equipped with adjustable trimming tabs or adjustable banking angle of the propeller. According to a preferred embodiment of the invention for providing a safe control, the control handle for the trimming angle or banking angle of the propeller alternatively, shall be accessibly arranged for adjustment of the desired position with the thumb or forefinger of the driver with maintained closed grip around the handle by the rest of the fingers.

In FIG. 4 an example is shown of a control handle which is suitable for adjustment of the trimming tabs or the banking angle of the propeller. The control handle is formed as a sliding control handle 17, which can be displaced substantially parallel with the longitudinal extension of the handle 4. The sliding control handle 17 is mounted on the thumb side of and in immediate vicinity of one of said handles to be accessible for adjustment of desired position without the driver having to open or lose the grip around the handle.

In an embodiment of the invention when the vessel is provided with two or more driving motors, the vessel is provided with a distribution function of the propulsion force between the motors, whereby the motors can give different propulsion force, which for instance implies that sharper turns can be made. According to a preferred embodiment of the invention for providing a safe control, the control handle for the distribution function of the propulsion force is mounted so that it is accessible for adjustment of the desired position with a thumb or forefinger of the driver with maintained closed grip around the handle with the rest of the fingers. The distribution between the driving units shall be made step-less.

Figure 5:
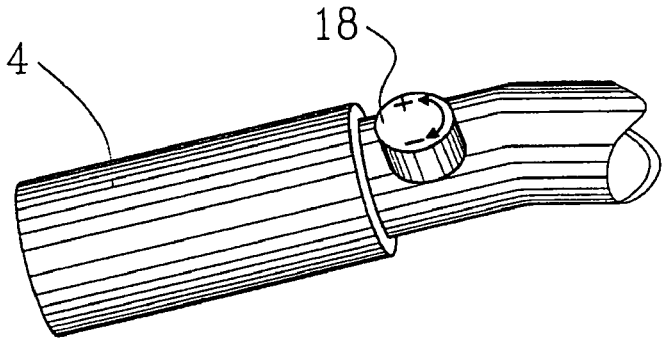
FIG. 5 shows an embodiment of a control handle suitable for distribution of propulsion force.

In an embodiment of the invention, shown in the FIG. 5, a control handle 18 is shown for distribution of propulsion force between the motors. The control handle 18 is mounted on the thumb side of the handle and in immediate vicinity of the handle 4, whereby adjustment of the control handle is made without the driver having to open or loose the grip around the handle 4. The control handle 18 is formed as a knob, which can be rotated around an axis, which is substantially perpendicular to the longitudinal extension of the handle 4. Preferably, the control handle 18 returns back to a zero position where the propulsion forces from the motors are equal.

In an alternative embodiment, the control handle can be formed as a sliding control handle according to what is shown in FIG. 2 or FIG. 4.

Figure 6:
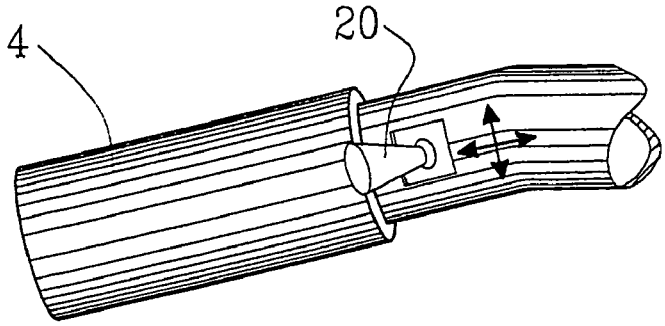
FIG. 6 shows a combined control handle in the form of a two dimensional rocker, a so-called joystick.

In a further preferred embodiment of the invention, a combined control handle in the form of a two-dimensional rocker arm, a so-called joystick. In FIG. 6, the arrangement Of this combined control handle is shown. The combined control handle 20 is mounted on the thumb side of the handle and in immediate vicinity of the handle 4, whereby adjustment of the control handle is made without the driver having to open or loose the grip around the handle 4. The combined control handle 20 is formed as a rocker arm, which is movable in two dimensions. In a preferred embodiment the combined control handle has a sideways fully spring back, i.e. along the extension of the handle bar. With this movement, the distribution of force between the motors is controlled according to what has been indicated above. The other degree of motion can then be used for adjustment of the trimming tabs or banking angle, shifting or reversing. In the case when the second dimension is used as a transmission control, there has to be distinctive positions. In the rest of the cases, step-less adjustment is allowed. The second dimension will not be provided with spring back.

Figure 7:
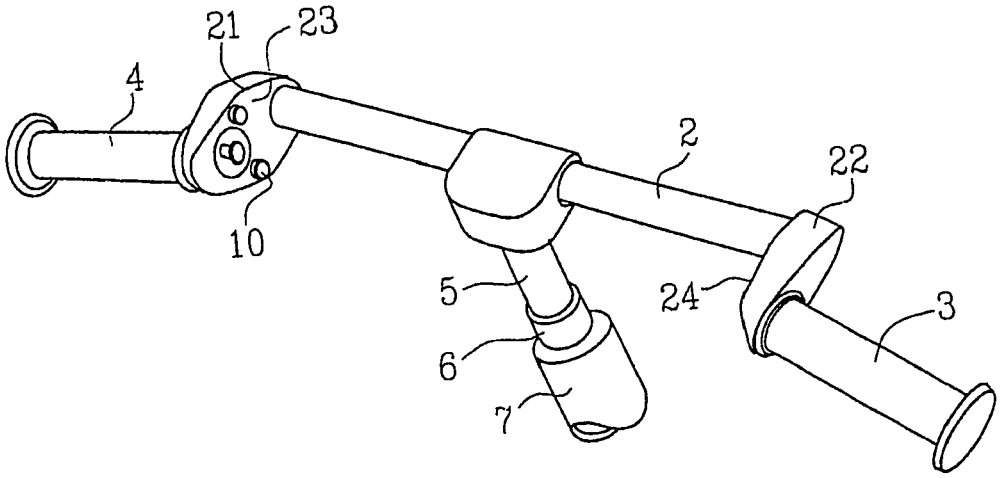
FIG. 7 shows an alternative embodiment of a control handle.

FIG. 7 shows a control handle 1 for a vessel which comprises a handle bar 2, which handle bar 2 is provided with a first handle 3 which has a throttle twist control and a second handle 4. The handle bar 2 is supported by a rotatably mounted steering axle 5, which is rotatably supported in a steering column 6, which is mounted on a support 7. The support is thereafter mounted to a not shown vessel in a known way. In a preferred embodiment of the invention, the handle bar 2 comprises a centre portion 8 which extends substantially perpendicular to the steering axle 5. Two handles 3, 4 extend on each side of the centre portion. Preferably, the handles 3, 4 are directed slightly backwards downwards in the vessel leading to an ergonomic grip as the pronation and the ulnar deviation of the hands decrease. In a preferred embodiment, the handles are inclined about 15° backwards towards the driver in relation to the centre portion of the handle bar.

Further, at least one additional control handle 10 is provided at one of said handles 3, 4, which control handle is arranged so that it is accessible for adjustment of desired position with a thumb or forefinger with a maintained closed grip around the handle by the rest of the fingers. The additional control handle or handles 11 are arranged on respective middle portions 21, 22 each belonging to a handle. The middle portions 21, 22 have surfaces 23, 24 which face each other. These surfaces extend substantially perpendicular to the longitudinal extension of the centre axis of the handle, whereby a good access is provided without having to loose the grip. The middle portion is provided with a connection to a centre portion 8 of the handle bar 1.

Figure 8:
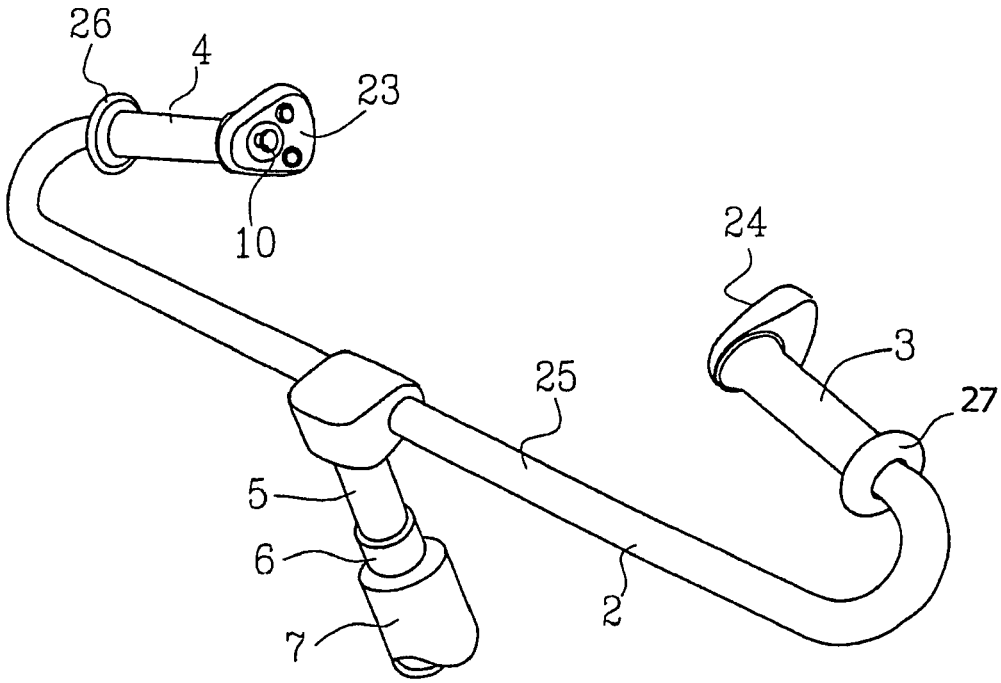
FIG. 8 shows a further alternative embodiment of a control handle.

FIG. 8 shows an alternative embodiment where the additional controls 10 are arranged on surfaces 23, 24, which surfaces are substantially facing each other and are formed on the end surfaces of handles 3, 4, which end surfaces are facing each other. Moreover, said handles 3, 4 are connected to each other via a connection rod 25 which is connected to said handle via the end surfaces facing away from each other of the handle.

What is claimed is:

1. A control bar for a marine vessel, the control bar comprising:

a rotatable steering axle, a handle bar that controls the steering axle, two handles supported on the handle bar, each handle being located at an extremity of the handle bar and defining a longitudinal axis, and at least one throttle control arranged in connection with one or both of the handles, where the throttle control is actuated by rotation about the respective longitudinal axis, wherein the handle bar is provided with at least one additional control, the additional control including a contacting portion arranged between one of the handles and a center line of the control bar, wherein the contacting portion of the additional control is adjacent to an end of the handle and the contacting portion is arranged entirely between the one handle and the center line of the control bar, said at least one additional control constitutes means for providing additional steering adjustment of the travel direction of the vessel by at least one of a group consisting of means for distributing the force between motors provided on the vessel, means for adjustment of an angular position of trimming tabs of the vessel, and means for adjustment of a banking angle of a propeller drive provided in the vessel;

wherein said at least one additional control includes the means for distributing the force between motors.

2. The control bar according to claim 1, wherein said additional control is arranged on a thumb side of and in immediate vicinity of said one of said handles.

3. The control bar according to claim 1, wherein said additional control comprises at least one push button, which is used as a transmission control, where said push button is arranged on a thumb side of and in immediate vicinity of one of said handles.

4. A marine vessel comprising:

a rotatable steering axle;

a control bar for said vessel that controls the steering axle, wherein said control bar comprises a handle bar, a first and a second handle, each of the first and the second handle being provided at an extremity of the handle bar and defining a longitudinal axis, and at least one throttle control arranged in connection with one or both of the handles, wherein the throttle control is actuated by rotating about the longitudinal axis, and at least one additional control, said additional control including a contacting portion arranged between one of the handles and a centerline of the control bar, wherein the contacting portion of the additional control is adjacent to an end of the handle and the contacting portion is arranged entirely between the one handle and the center line of the control bar, and said at least one additional control constitutes means for providing additional steering adjustment of the travel direction of the vessel by at least one of a group consisting of means for distributing the force between motors provided on the vessel, means for adjustment of an angular position of trimming tabs of the vessel, and means for adjustment of a banking angle of a propeller drive provided in the vessel;

wherein said at least on additional control includes the means for distributing the force between motors.

5. The vessel according to claim 4, wherein said control is arranged on a thumb side of and in immediate vicinity of said one of said handles.

6. A control bar for a marine vessel, the control bar comprising:

a rotatable steering axle, a handle bar that controls the steering axle, two handles supported on the handle bar, each handle being located at an extremity of the handle bar and defining a longitudinal axis, and at least one throttle control arranged in connection with one or both of the handles, where the throttle control is actuated by rotation about the respective longitudinal axis, wherein the handle bar is provided with at least one additional control, the additional control including a contacting portion arranged between one of the handles and a center line of the control bar, wherein the contacting portion of the additional control is adjacent to an end of the handle and the contacting portion is arranged entirely between the one handle and the center line of the control bar, said at least one additional control constitutes means for providing additional steering adjustment of the travel direction of the vessel by at least one of a group consisting of means for distributing the force between motors provided on the vessel, means for adjustment of an angular position of trimming tabs of the vessel, and means for adjustment of a banking angle of a propeller drive provided in the vessel;

wherein said at least one additional control includes the means for adjustment of a banking angle.

7. A marine vessel comprising:

a rotatable steering axle;

a control bar for said vessel that controls the steering axle, wherein said control bar comprises a handle bar, a first and a second handle, each of the first and the second handle being provided at an extremity of the handle bar and defining a longitudinal axis, and at least one throttle control arranged in connection with one or both of the handles, wherein the throttle control is actuated by rotating about the longitudinal axis, and at least one additional control, said additional control including a contacting portion arranged between one of the handles and a centerline of the control bar, wherein the contacting portion of the additional control is adjacent to an end of the handle and the contacting portion is arranged entirely between the one handle and the center line of the control bar, and said at least one additional control constitutes means for providing additional steering adjustment of the travel direction of the vessel by at least one of a group consisting of means for distributing the force between motors provided on the vessel, means for adjustment of an angular position of trimming tabs of the vessel, and means for adjustment of a banking angle of a propeller drive provided in the vessel;

wherein said at least on additional control includes the means for adjustment of a banking angle.

* * * * *